US005447302A

United States Patent [19]

Curley

[11] Patent Number: 5,447,302

[45] Date of Patent: Sep. 5, 1995

[54] DIFFERENTIAL GRIPPER MECHANISM

[75] Inventor: Richard D. Curley, North Reading, Mass.

[73] Assignee: AM International, Inc., Mount Prospect, Ill.

[21] Appl. No.: 276,212

[22] Filed: Jul. 15, 1994

Related U.S. Application Data

[63] Continuation of Ser. No. 30,824, Mar. 12, 1993, abandoned.

[51] Int. Cl.[6] ..... B65H 5/02

[52] U.S. Cl. ..... 271/277; 271/11

[58] Field of Search ..... 271/81-83, 271/277, 11, 94; 101/409

[56] References Cited

U.S. PATENT DOCUMENTS

| | | | |
|---|---|---|---|
| 2,425,936 | 8/1947 | Hepp . | |
| 2,903,260 | 9/1959 | Faeber . | |
| 3,455,547 | 7/1969 | Rudolph et al. | 271/82 |
| 3,463,484 | 8/1969 | Rudolph | 271/82 |
| 3,510,119 | 5/1970 | Linden | 271/277 X |
| 4,132,403 | 1/1979 | Weisbach et al. | 271/277 |
| 4,358,100 | 11/1982 | Muller | 271/277 X |
| 4,895,073 | 1/1990 | Wieland | 271/277 X |
| 4,901,996 | 2/1990 | Schlough . | |

*Primary Examiner*—H. Grant Skaggs

*Attorney, Agent, or Firm*—Herbert L. Lerner; Laurence A. Greenberg

[57] ABSTRACT

An apparatus for removing paper products from a stack on a hopper comprises a rotatably mounted gripper drum for rotating about a central axis at a substantially constant angular velocity. A stationary cam is rigidly mounted adjacent the gripper drum. A gripper mechanism is mounted on the gripper drum and rotates with the drum. The gripper mechanism is provided for gripping a paper product, removing the paper product from a stack and for entraining the paper product with the rotating gripper drum. A linkage mechanism which is also mounted on the gripper drum and which rotates with the drum is provided for angularly displacing the gripper mechanism relative to the gripper drum, i.e. to accelerate and to decelerate the gripper, and for operatively linking the gripper mechanim with the cam.

9 Claims, 8 Drawing Sheets

DIFFERENTIAL GRIPPER MECHANISM

This application is a continuation of application Ser. No. 08/030,824, filed Mar. 12, 1993 now abandoned.

BACKGROUND OF THE INVENTION

1. Field of the Invention

The invention relates to a gripper mechanism, i.e. a device used to pull single product such as signatures and newspapers from a pile and transport them to another device for further processing, such as for binding, stitching, collating or insulating.

2. Description of the Related Art

Gripper mechanisms work in conjunction with other mechanisms mounted on a common frame. Such an assembly is referred to as a hopper. The invention of the instant application pertains to the type of hoppers as they are commercially available, from Muller Martini, McCain, AM Graphics and Ferag, to name just a few.

Most of these commercially available hoppers are similar in operation. Paper is placed on a paper tray and aligned at a registration point above the gripper drum. This may be done either manually or automatically. A sucker mechanism, e.g. a vacuum-operated suction cup array, pulls a single paper product downwardly. As a gripper seat passes under the leading edge of the paper product, a cam actuated gripper clamps the product and pulls the same from the pile.

As the gripper drum rotates with a constant angular velocity, the period of angular alignment between the gripper seat and the leading edge of the product is very short. A relative slip occurs between the just-gripped and the completely-gripped condition. That timing, however, is very crucial and, in the prior art devices, leads to an increased number of hopper faults. For instance, the gripper may miss the product altogether, it may pull it out of the pile only partially, it may grab more than one product, or it may rip the product due to the extremely quick transfer of momentum. At higher speeds, these problems are compounded and often result in a significant production loss.

Various attempts at solving these shortcomings have been made in the art. One such solution has been to employ two half-speed hoppers for one location. Other solutions include increasing the gripper force and/or providing different gripper seats and gripper materials.

Gripper apparatus of this general kind are exemplified in U.S. Pat. Nos. 2,425,936 and 2,903,260, for instance. The patents disclose signature feeders which have signature feed mechanisms which move relative to a rotating drum and in a direction opposite to drum rotation. Accordingly, the mechanism is slowed down relative to the rotation of the drum at the time of engagement with a signature.

U.S. Pat. No. 4,901,996 to James Schlough pertains to a gripper drum for removing paper signatures from a stack and for feeding them to a collator conveyor. The signature is drawn into the rotating drum at a speed approximately identical to the outer surface velocity of the drum. Once the signature is fully inserted in the drum, it is accelerated in the direction of drum rotation and, after a given arcuate distance has been traversed, the signature is pushed from the storage rack within the drum and fed to the collator feeder.

Furthermore, prior art gripper mechanisms are provided with a spring system for closing the gripper jaw with a compression or tension spring. The spring, which is pre-biased in the open-jaw position, is unloaded when the gripper closes. This causes a reduction in gripper force at the time when it is most needed, i.e. at the time the paper must be pulled from the stack. Increasing the spring size, however, places increased loads on the drum as the spring is compressed. In one possible solution to the problem, a prior art gripper (AM Graphics hopper) is provided with a separate cam system to move the ground point of the spring. In order to attain sufficient gripper force, however, the cam follower is required to leave the cam.

SUMMARY OF THE INVENTION

It is accordingly an object of the invention to provide a gripper mechanism, which overcomes the hereinafore-mentioned disadvantages of the heretofore-known devices of this general type and which makes it possible to increase production speed while decreasing mishandling of a paper product when it is unloaded from the hopper.

With the foregoing and other objects in view there is provided, in accordance with the invention, an apparatus for removing paper products from a stack on a hopper, comprising:

a rotatably mounted gripper drum for rotating about a central axis at a substantially constant angular velocity;

a stationary cam rigidly mounted adjacent the gripper drum;

gripper means mounted on the gripper drum for gripping a paper product, removing the paper product from a stack and for slaving the paper product along in a direction of rotation of the gripper drum; and linkage means mounted on the gripper drum for angularly displacing the gripper means relative to the gripper drum and for operatively linking the gripper means with the cam.

In accordance with an added feature of the invention, the linkage means include a cam follower riding on a cam surface of the cam, a first link having a first end operatively connected to the cam follower, a pivot joint for pivoting the first link about an axis substantially parallel to the central axis of rotation of the drum, and a second end; a second link and a toggle arm, the second link being pivotally connected to the second end of the first link and to the toggle arm; the toggle arm carrying the gripper means and being pivotable about the central axis.

It has been found to be a very advantageous improvement over the prior art to provide a gripper and gripper seat on a toggle arm and a gripper which rotates relative to the gripper seat and the arm from an open position to a closed position as the arm moves opposite the direction of drum rotation.

With the apparatus according to the invention, more time is provided for the actual gripping function without affecting production speed. The acceleration of the product away from the hopper pile is considerably smoother. Any "yanking" motion is avoided. The gripper seat and the gripper jaw are free to move on the gripper drum. By rotating the drum in one direction and the gripper in the opposite direction, a relative slowing of the gripper motion is attained.

It must be noted that the relative motion of the gripper at one point of the drum rotation is in a direction advancing the drum. This leads to an increase in gripper motion, i.e. the gripper is moved away from the paper at a higher speed. This is very advantageous in dropping off the product.

In accordance with an additional feature of the invention, the cam has a peripheral cam surface and the linkage means include a cam follower roller riding on the peripheral surface.

In accordance with a further feature of the invention, the apparatus includes gripper fingers disposed on the toggle arm adjacent the gripper seat and being pivotally supported on a pivot shaft, a gear segment rigidly supported on the gripper drum and having a radius of curvature originating at the central axis, and spur gear means disposed on the pivot shaft and meshing with the gear segment for translating a relatively smaller angular displacement of the toggle arm in a given direction into a relatively greater angular displacement of the gripper fingers in the given direction.

In accordance with yet another feature of the invention, the gripper fingers are spring-biased with flat wound power spring means operatively connected to the gripper fingers for biasing the gripper fingers in an angular direction towards the gripper seat.

In accordance with yet an added feature of the invention, the gripper fingers include a support bearing surrounding the pivot shaft, the support bearing and the pivot shaft defining a space therebetween for allowing a translational deflection of the support bearing relative to the pivot shaft.

Specifically in view of the problem of providing a constant gripper force, and for the purpose of obtaining a smooth acceleration of the product when gripping occurs, a flat wound power spring is incorporated in the gripper. As the gripper closes, the spring allows the gripper to deflect about its pivot axis so as to compensate for different size products. Also, as the gripper closes, the compression spring unloads and the toggle mechanism increases in efficiency. Therefore, the transmitted force is relatively constant. The cam follower, meanwhile, maintains contact with the cam so that the mechanism follows the prescribed acceleration curve. The torque curve obtained with the gripper of the invention is thus relatively flat.

In accordance with a concomitant feature of the invention, the linkage means are two identical toggle links disposed on the gripper drum at an angular displacement of 180° relative to one another, each of the toggle links including a cam follower riding on a cam surface of the cam, a first link having a first end operatively connected to the cam follower, a pivot joint for pivoting the first link about an axis substantially parallel to the central axis of rotation of the drum, and a second end; a second link and a toggle arm, the second link being pivotally connected to the second end of the first link and to the toggle arm; the toggle arm carrying the gripper means and being pivotable about the central axis.

Other features which are considered as characteristic for the invention are set forth in the appended claims.

Although the invention is illustrated and described herein as embodied in a differential gripper mechanism, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
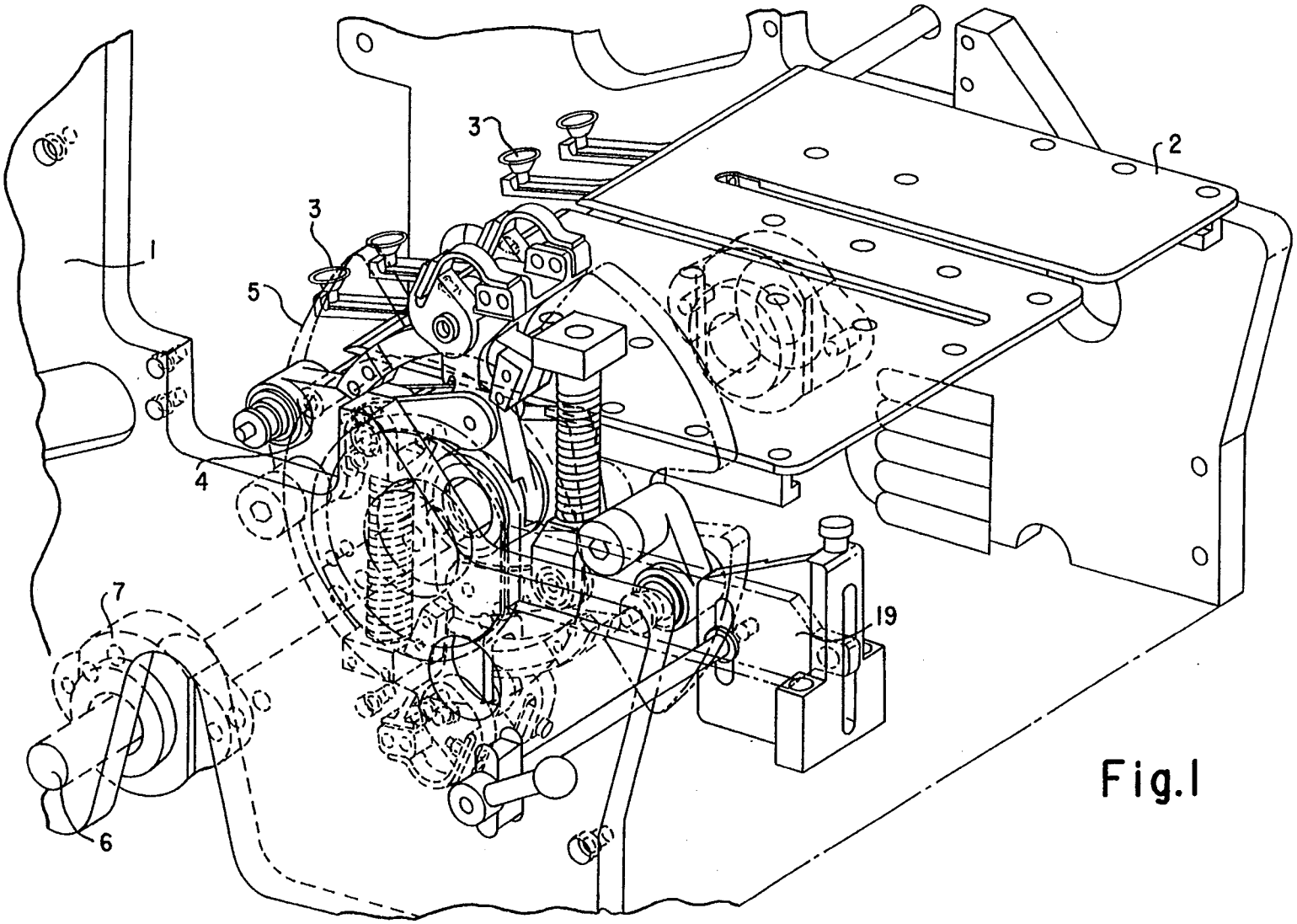
FIG. 1 is a perspective view of a hopper and gripper drum assembly, all non-essential parts having been omitted from the drawing.

Referring now to the figures of the drawing in detail and first, particularly, to FIG. 1 thereof, there is seen a hopper frame 1, on which a paper tray 2 is rigidly mounted. Several non-essential features are not illustrated so as to provide a clearer view of the invention. Suction cups or sucker cups 3 are rotatably mounted on a sucker bar 4, supported in the hopper frame 1. The suction device is operated in a known manner, so that no specific description is deemed to be necessary.

Figure 4:
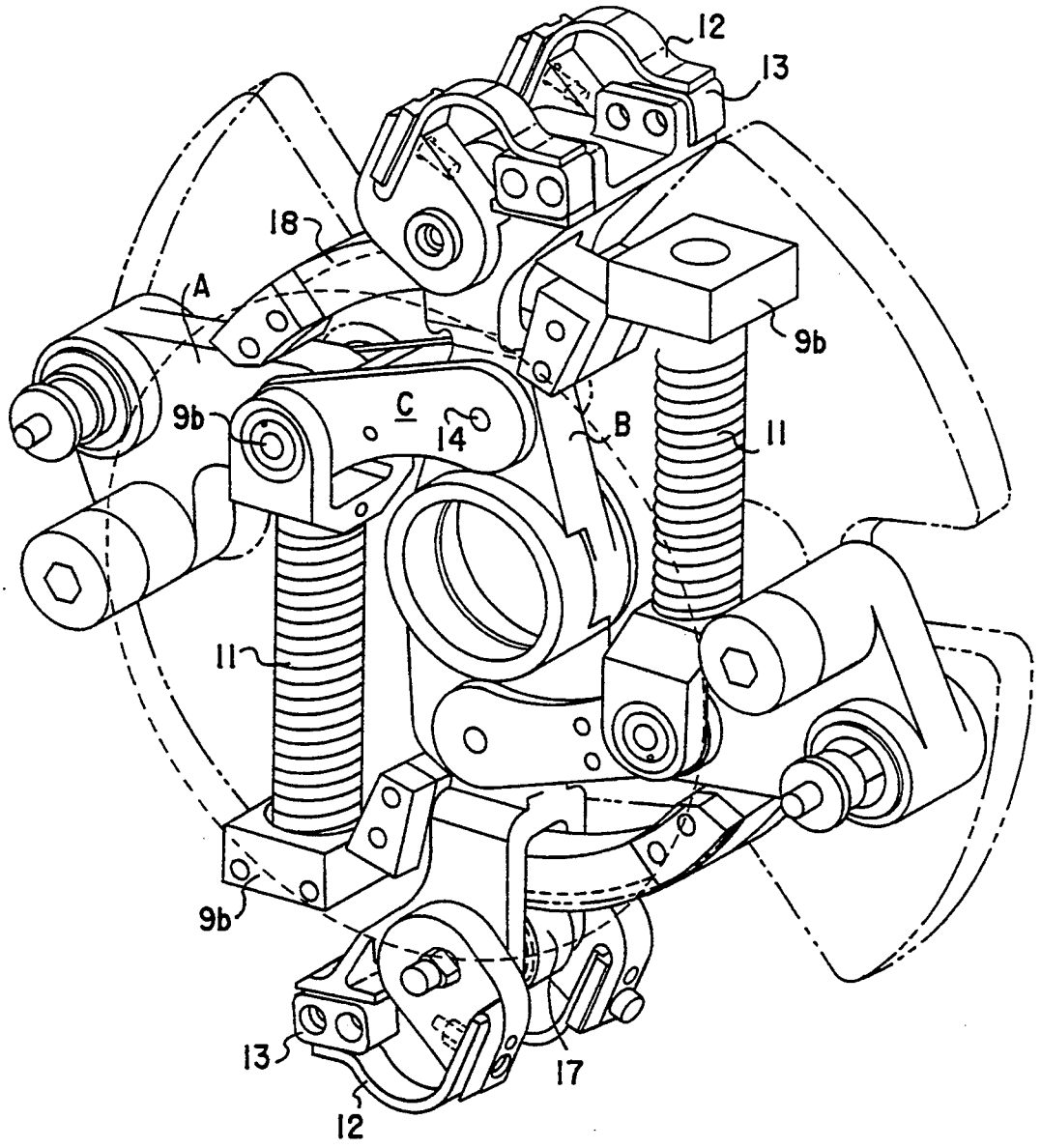
FIG. 4 is a perspective view of the novel gripper mechanism.

With reference to FIGS. 1 and 4, a gripper drum 5 rotates about a central axis at an essentially constant angular velocity. The assembly is mounted on a drive shaft 6, which is supported in the hopper frame 1 in support bearings 7 and is driven by a non-illustrated drive motor.

Figure 2:
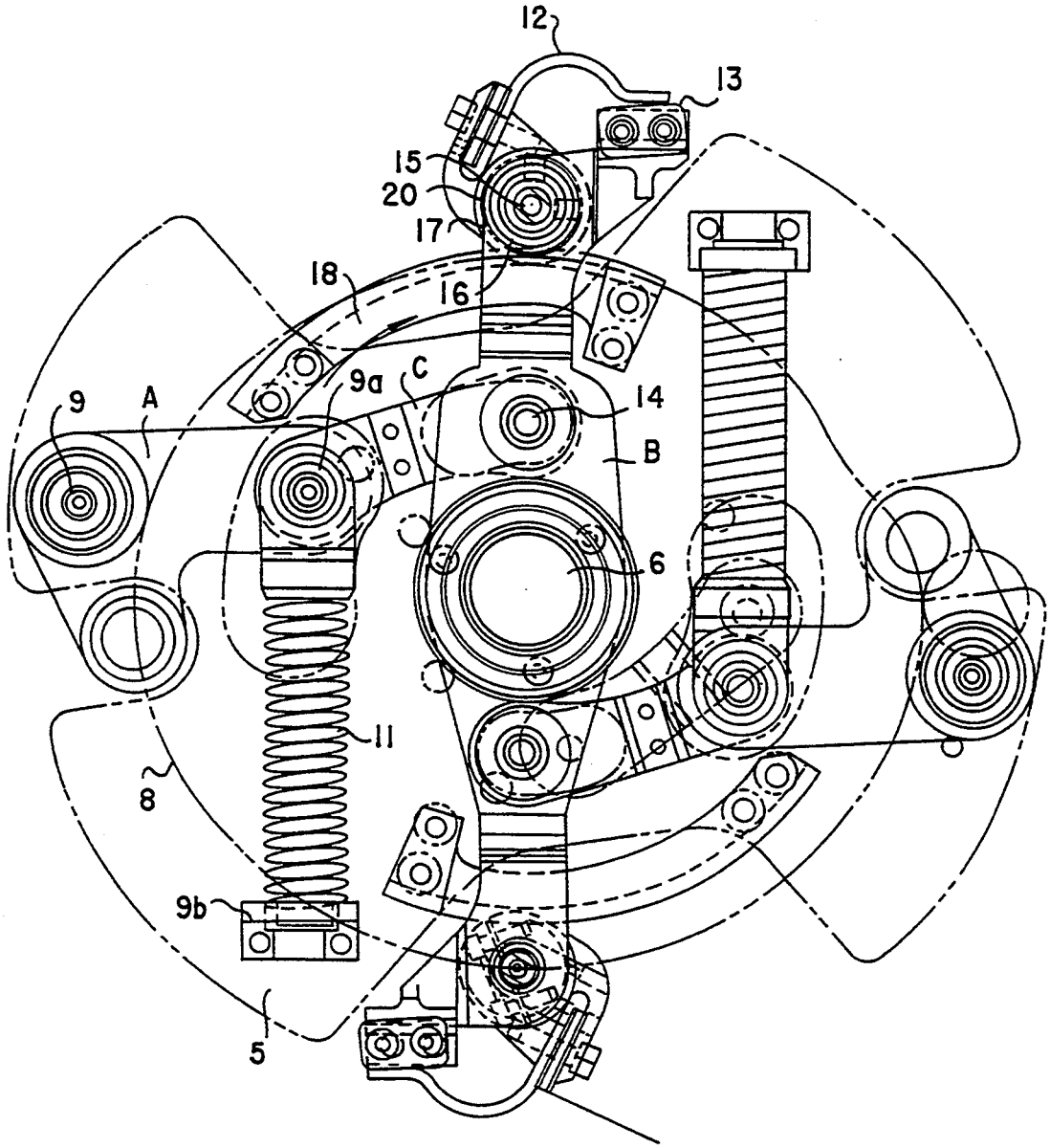
FIG. 2 is a diagrammatic, side-elevational view of the gripper drum and gripper toggle arm assembly according to the invention.

As shown in FIG. 2, a stationary gripper cam 8 is nonrotatably mounted in the hopper frame 1. A gripper mechanism includes a cam follower 9 attached to one end of an L-shaped link A. Any movement of the cam follower 9 causes the link A to pivot about a pin 10 and translates into a movement of the other end of the link A which is attached to a compression spring 11 in a bearing 9*a*. Accordingly, a cam follower motion towards the axis of rotation, i.e. a cam depression, causes the spring 11 to extend and a cam follower motion away from the axis of rotation, i.e. a cam lobe, causes the spring 11 to be compressed. The spring 11 has a spring base 9*b* which is mounted stationary relative to the rotating gripper drum 5. A link C is mounted between the bearing 9*a* and a bearing 14 in a toggle arm or link B. The toggle arm B provides the support for a gripper 12 and a gripper seat 13.

The link C is rotatable about both of its ends, namely in the bearing 9*a* of the spring 11, i.e. coaxially with the link A and centrally in the toggle arm B in the bearing 14. The toggle arm B is rotatable about the drive shaft 6. In other words, while the toggle arm B rotates generally with the drum 5, it is also able to perform an angular movement relative to the drum 5. In terms of its angular motion, any non-round portion of the cam 8 causes the toggle arm B to fall out of phase relative to the angular motion of the drum 5. Any round portion of the cam 8 causes the phase angle between the toggle arm B and the drum 5 to remain constant.

The near linear movement of the end.9*a* towards the spring base 9*b* (spring compression) causes the link C to "pull" the toggle arm B and thus to rotate the toggle arm B counter-clockwise relative to the drum, as viewed in FIG. 2, i.e. the toggle arm B is accelerated. When the spring 11 is extended, the angular motion of the toggle arm B about the drive shaft 6 is decelerated. In yet other terms, the linear distance between the pin 10 and the bearing 14 is inversely proportional to the centripetal movement of the cam follower, i.e. when the cam radius is small, the distance between 10 and 14 is large, and when the cam radius is large, the distance between 10 and 14 is small.

As mentioned above, the toggle arm B supports the gripper 12 and the gripper seat 13. The gripper seat 13 is provided with conventional gripper friction material so as to provide optimum gripping of the paper product when the gripper is closed. The gripper 12 includes two gripper jaws or gripper fingers which are symmetrically mounted on the toggle arm B. The gripper fingers may be formed of a resilient material. A shaft 15 extends through rotary bearings 16 provided in the toggle arm B. A gear wheel 17 rigidly mounted on the shaft 15 meshes with a gear segment 18, which is rigidly mounted on the drum 5. Any counter-clockwise movement of the toggle arm B relative to the drum 5, as viewed in FIG. 2, causes the gripper 12 to pivot in the same angular direction and thus open the gripper jaw.

Figure 6:
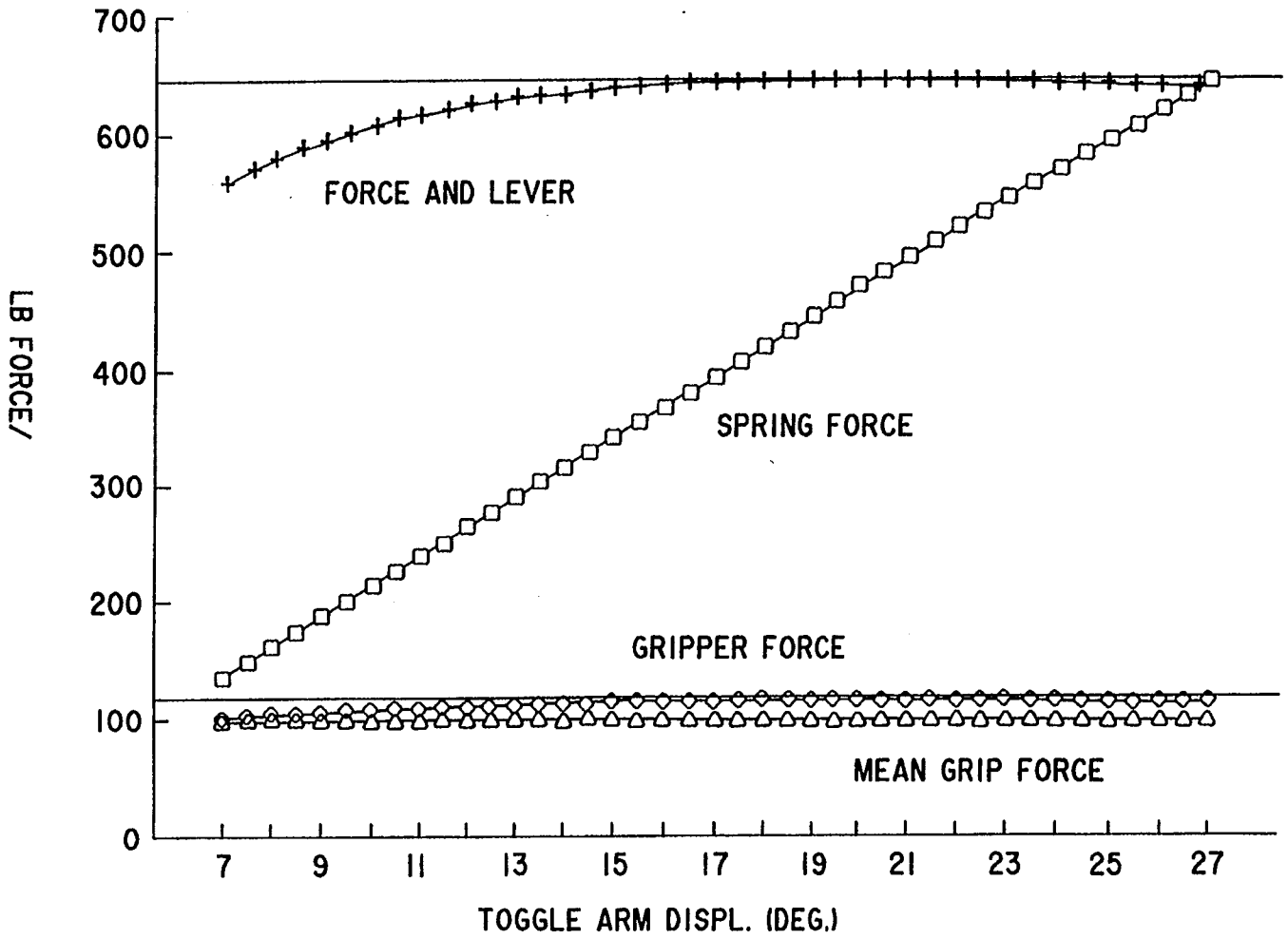
FIG. 6 shows force diagrams relative to the toggle arm displacement of the gripper seat.

With reference to the force diagram of FIG. 6 and the illustration of FIG. 2, a substantially constant gripper force and a smooth acceleration of the product in the gripping process is achieved by incorporating a flat wound power spring 20 in the gripper mechanism. As the gripper 12 closes, the spring 20 allows the gripper 12 to deflect about its pivot axis so as to compensate for different size products. The cam follower 9, meanwhile, maintains contact with the cam 8 so that the mechanism follows the prescribed acceleration curve. The torque curve obtained with the gripper of the invention is thus relatively flat.

Figure 2C:
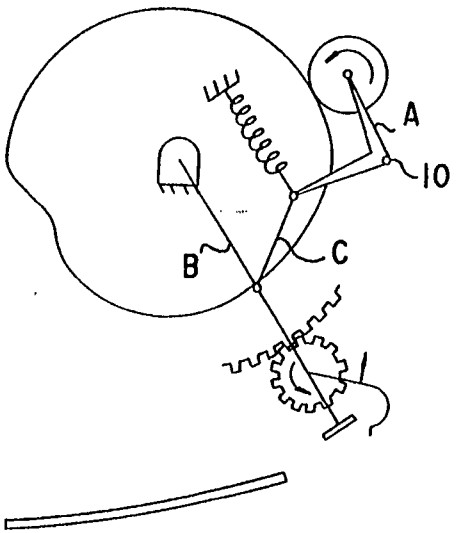
FIGS. 2*a* to 2*c* are diagrammatic stick-drawings showing the novel gripper mechanism in three operational stages.
Figure 2B:
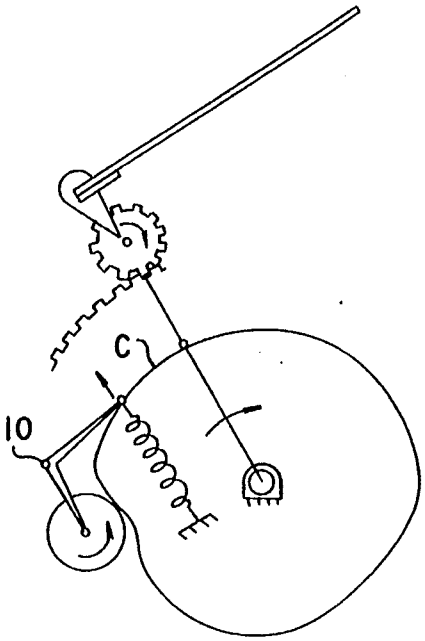
Figure 2A:
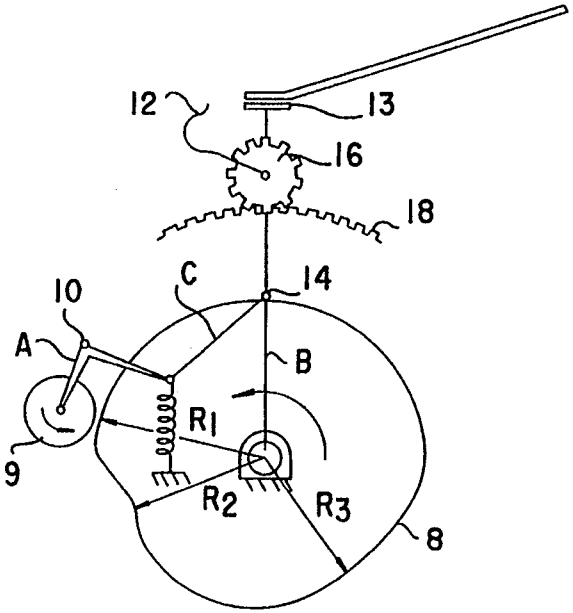

With reference to the kinematic sketches of FIG. 2*a*, 2*b* and 2*c*, the cam radius $R_1$ is associated with an open gripper position. The cam radius $R_2$ is associated with a closed gripper position. The compression spring 11 aids in the closing of the gripper 12, provides a clamping force when the gripper is closed and, additionally, facilitates proper movement of the cam follower 9 on the cam periphery.

FIG. 2*a* shows the gripper in an open position. The suction cups 3 have just pulled a paper product onto the gripper seat 13. The cam follower 9, which rotates counter-clockwise about the stationary cam 8 is positioned at the large cam radius $R_1$. The spring 11 is compressed, i.e. the distance between the pin 10 and the bearing 14 is small.

Referring now to FIG. 2*b*, the cam follower 9 has just entered the cam depression at the radius $R_2$. The spring 11 is extended and the distance between 10 and 14 is at a maximum. During the counter-clockwise rotation of the gripper mechanism (at the angular velocity of the drum 5) from the position 2*a* to the position 2*b*, the toggle arm B has slowed down relative to the drum 5. This has caused the gear 17 to mesh with the gear segment 18 and to close the gripper 12.

When, at the point of drop-off of the paper product, the cam radius again increases, the toggle arm B is accelerated from its constant velocity (with the drum). In other words, after the gripper jaw has been closed in the position 2*b*, the toggle arm B has traveled at the constant speed of the gripper drum 5. As the cam causes the gripper jaw to open by displacing the same counter-clockwise relative to the gripper drum 5, the gripper jaw is virtually "yanked away" from the paper product.

Figure 5A:
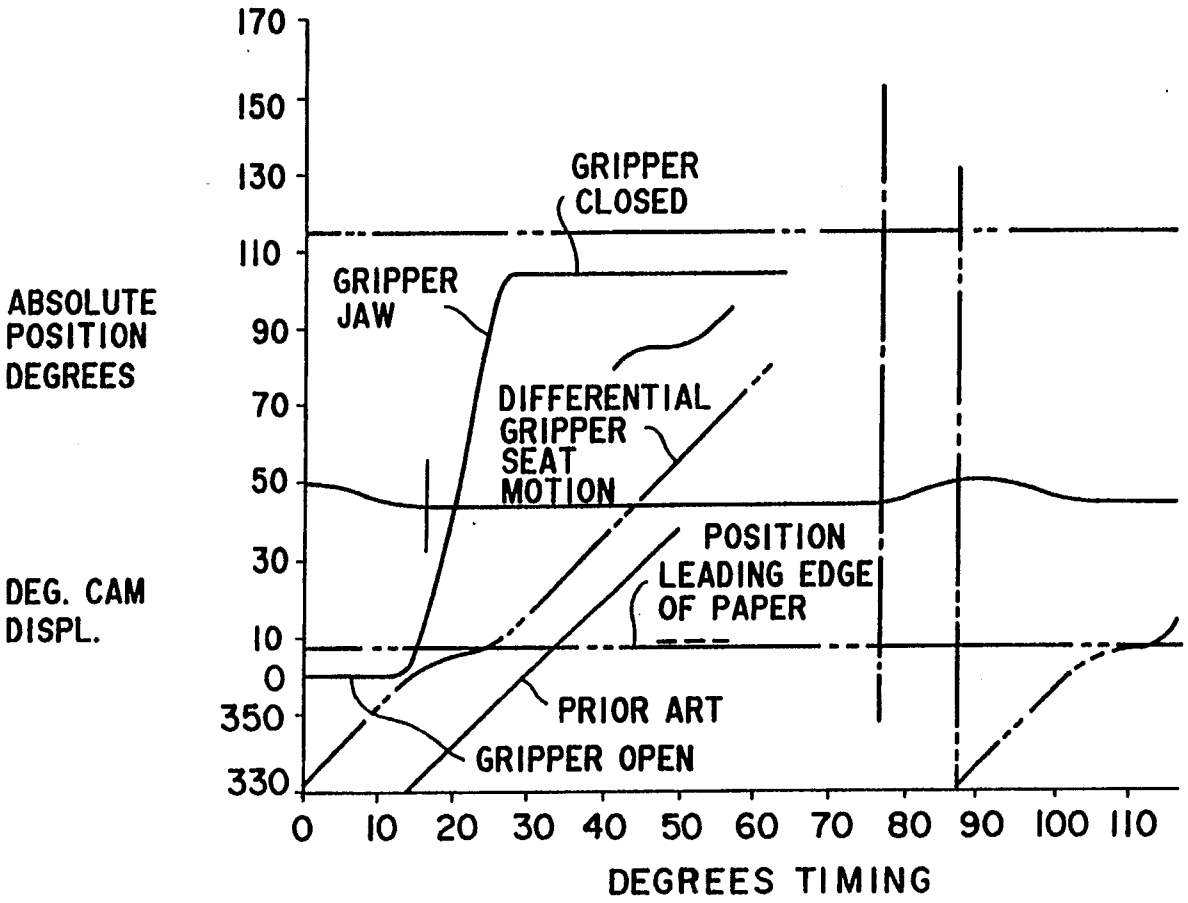
FIG. 5*a* is a timing diagram showing the angular position of the drum and the relative timing behavior of the gripper.

With reference to FIG. 5*a*, the advantageous differences between the operation of the prior art apparatus and the operation of the apparatus according to the invention are clearly illustrated. The ordinate (y-axis) refers to the angular position of the gripper seat and the abscissa (x-axis) shows the phase angle or timing angle. The straight line labeled "Prior Art" exemplifies the linear relationship, while the curved line labeled "Differential Gripper Seat Motion" illustrates the slowdown in the range from 30° to 50°.

Figure 5B:
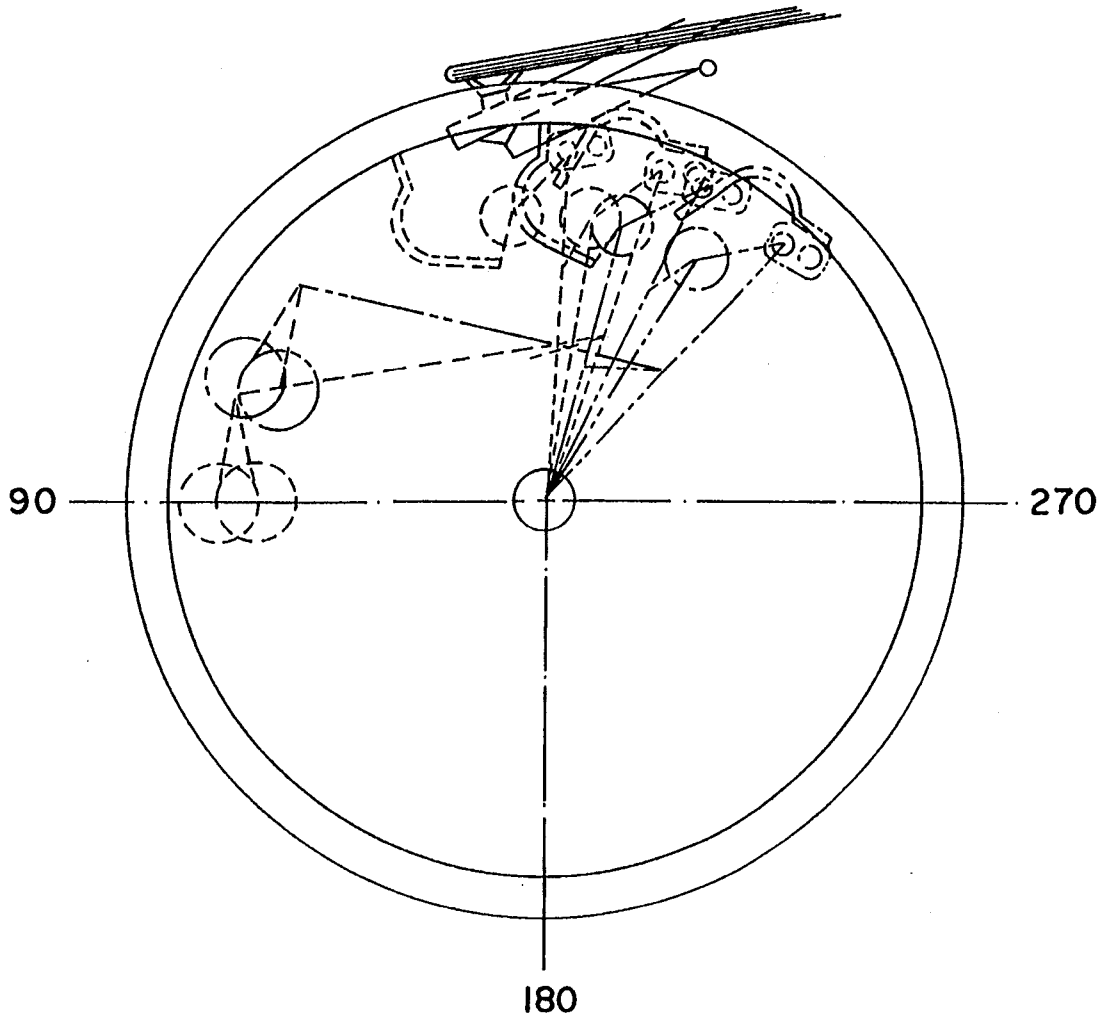
FIG. 5*b* illustrates angular positions corresponding to the timing diagram of FIG. 5*a*.

The curve labeled "Gripper Jaw" which relates to the opening between the gripper 12 and the gripper seat 13, details the behavior of the gripper 12 in relation to the angular position of the drum 5. While a 1:1 ratio of cam-operated gripper relative to the rotation of the drum would lead to a straight line, it is shown that, according to the invention, the gripper jaw has an extended "open" period and a very quick closure period. The transition from the open to the closed position, during which slippage of the product may occur, is considerably shortened and the gripper is fully closed at approximately 55°. The angular positions referred to in FIG. 5*a* are illustrated diagrammatically in FIG. 5*b*.

Figure 3:
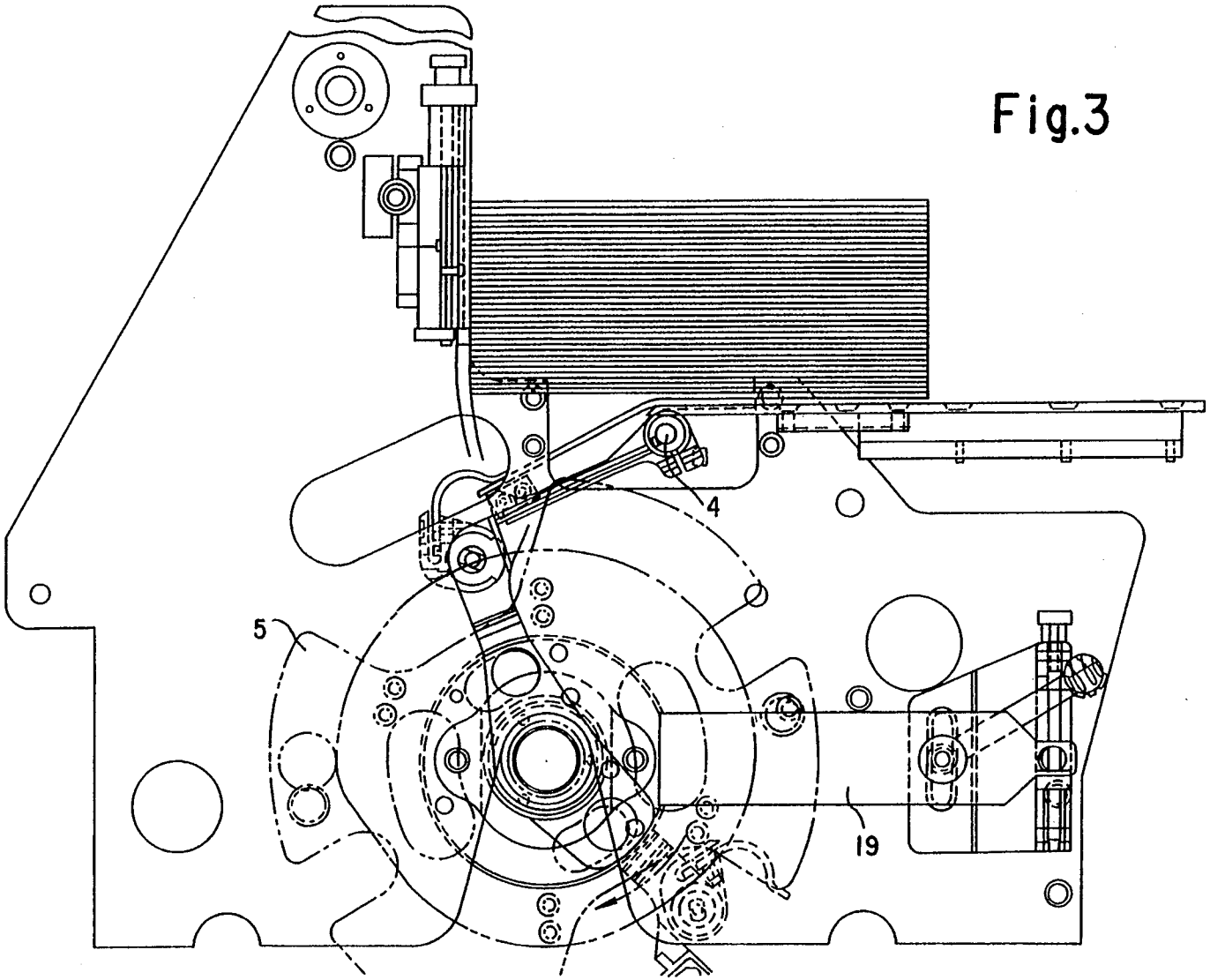
FIG. 3 is a side-elevational view of essential parts of the hopper and gripper drum assembly of FIG. 1.

With reference to FIGS. 1 and 3, the cam positions may be fine-adjusted by means of a cam arm 19 which is rigidly connected to the cam 8. It will be understood by a person of skill in the art that an adjustment in the cam arm 19, and thus in the cam 8, changes the timing pattern of the gripper mechanism relative to the angular position of the drum 5.

With reference to FIG. 6, which illustrates the grip force obtained in an exemplary embodiment of the invention relative to the toggle arm B displacement in degrees. As can be seen from the straight curve, the spring force increases substantially linearly, while the mean gripper force remains virtually constant through the 20 degrees of displacement.

I claim:

1. An apparatus for removing paper products from a stack on a hopper, comprising:

a rotatably mounted gripper drum for rotating about a central axis at a substantially constant angular velocity;

gripper means mounted on said gripper drum for gripping a paper product, removing the paper product from a stack and for slaving the paper product along in a direction of rotation of said gripper drum;

a single stationary cam mounted adjacent said gripper drum for deflecting said gripper means relative to said gripper drum and for simultaneously actuating said gripper means to selectively assume a closed gripper position and an open gripper position;

linkage means mounted on said gripper drum for angularly accelerating said gripper means relative to said gripper drum while said gripper means are in the closed position in which the paper product is slaved along in the direction of rotation of said gripper drum and for operatively linking said gripper means with said single cam; and means for translating a relatively smaller angular displacement of said linkage means into a relatively greater angular displacement of said gripper means.

2. The apparatus according to claim 1, wherein said linkage means include a cam follower riding on a cam surface of said cam, a first link having a first end operatively connected to said cam follower, a pivot joint f-or pivoting said first link about an axis substantially parallel to said central axis of rotation of said drum, and a second end; a second link and a toggle arm, said second link being pivotally connected to said second end of said first link and to said toggle arm; said toggle arm carrying said gripper means and being pivotable about said central axis.

3. The apparatus according to claim 1, wherein said cam has a peripheral cam surface and said linkage means include a cam follower roller riding on said peripheral surface.

4. An apparatus for removing paper products from a stack on a hopper, comprising:

a rotatably mounted gripper drum for rotating about a central axis at a substantially constant angular velocity;

a stationary cam rigidly mounted adjacent said gripper drum;

gripper means mounted on said gripper drum for gripping a paper product, removing the paper product from a stack and for slaving the paper product along in a direction of rotation of said gripper drum; and linkage means mounted on said gripper drum for angularly displacing said gripper means relative to said gripper drum and for operatively linking said gripper means with said cam; said linkage means further including a cam follower riding on a cam surface of said cam, a first link having a first end operatively connected to said cam follower, a pivot joint for pivoting said first link about an axis substantially parallel to said central axis of rotation of said drum, and a second end; a second link and a toggle arm, said second link being pivotally connected to said second end of said first link and to said toggle arm; said toggle arm carrying said gripper means and being pivotable about said central axis;

said gripper means including a gripper seat disposed on said toggle arm and fingers adjacent said gripper seat, said gripper fingers being pivotally supported on a pivot shaft, a gear segment rigidly supported on said gripper drum and having a radius of curvature originating at said central axis, and spur gear means disposed on said pivot shaft and meshing with said gear segment for translating a relatively smaller angular displacement of said toggle arm in a given direction into a relatively greater angular displacement of said gripper fingers in the given direction.

5. The apparatus according to claim 4, including flat wound power spring means operatively connected to said gripper fingers for biasing said gripper fingers in an angular direction towards said gripper seat.

6. The apparatus according to claim 5, wherein said gripper fingers include a support bearing surrounding said pivot shaft, said support bearing and said pivot shaft defining a space therebetween for allowing a translational deflection of said support bearing relative to said pivot shaft.

7. An apparatus for removing paper products from a stack on a hopper, comprising:

a rotatably mounted gripper drum for rotating about a central axis at a substantially constant angular velocity;

gripper means mounted on said gripper drum for gripping a paper product, removing the paper product from a stack and for slaving the paper product along in a direction of rotation of said gripper drum;

a single stationary cam mounted adjacent said gripper drum for deflecting said gripper means relative to said gripper drum and for simultaneously actuating said gripper means;

linkage means mounted on said gripper drum for angularly accelerating said gripper means relative to said gripper drum and for operatively linking said gripper means with said single cam; and means for translating a relatively smaller angular displacement of said linkage means into a relatively greater angular displacement of said gripper means, wherein said cam has a cam surface and wherein said linkage means are two identical toggle links disposed on said gripper drum at an angular displacement of 180° relative to one another, each of said toggle links including a respective cam follower riding on said cam surface of said cam, a first link having a first end operatively connected to said cam follower, a pivot joint for pivoting said first link about an axis substantially parallel to said central axis of rotation of said drum, and a second end; a second link and a toggle arm, said second link being pivotally connected to said second end of said first link and to said toggle arm; said toggle arm carrying said gripper means and being pivotable about said central axis.

8. An apparatus for removing paper products from a stack on a hopper, comprising:

a rotatably mounted gripper drum for rotating about a central axis at a substantially constant angular velocity;

a single stationary cam rigidly mounted adjacent said gripper drum, said cam having a cam surface;

gripper means mounted on said gripper drum for gripping a paper product, removing the paper product from a stack and for slaving the paper product along in a direction of rotation of said gripper drum; and linkage means mounted on said gripper drum for angularly displacing said gripper means relative to said gripper drum and for operatively linking said gripper means with said single stationary cam; said linkage means being in the form of a toggle link disposed on said gripper drum, said toggle link including a cam follower riding on said cam surface of said single stationary cam, a first link having a first end operatively connected to said cam follower, a pivot joint for pivoting said first link about an axis substantially parallel to said central axis of rotation of said drum, and a second end; a second link and a toggle arm, said second link being pivotally connected to said second end of said first link and to said toggle arm; said toggle arm carrying said gripper means and being pivotable about said central axis.

9. The apparatus according to claim 8, including spring means connected to said toggle link for selectively accelerating and decelerating said toggle arm, said spring means being selectively compressed and allowed to expand an response to a radial movement of said cam follower.

* * * * *